US005099807A

United States Patent [19]

Devine

[11] Patent Number: 5,099,807

[45] Date of Patent: Mar. 31, 1992

[54] PRELOADED AXLE STAKE FOR ROLLER FOLLOWER

[75] Inventor: Douglas L. Devine, Marshall, Mich.

[73] Assignee: Eaton Corporation, Cleveland, Ohio

[21] Appl. No.: 744,187

[22] Filed: Aug. 14, 1991

[51] Int. Cl.[5] ..... F01L 1/14

[52] U.S. Cl. ..... 123/90.48; 123/90.5; 74/569; 29/888.43; 29/889.09; 29/523

[58] Field of Search ..... 123/90.48, 90.5, 90.51, 123/90.39, 90.44; 74/569; 29/888.43, 888.09, 523, 522.1

[56] References Cited

U.S. PATENT DOCUMENTS

| | | | |
|---|---|---|---|
| 1,435,925 | 11/1922 | Jardine | 29/888.43 |
| 4,628,874 | 12/1986 | Barlow | 29/888.43 |
| 4,697,473 | 10/1987 | Patel | 123/90.44 |
| 4,727,832 | 3/1988 | Miyamura et al. | 123/90.44 |
| 4,796,483 | 1/1989 | Patel et al. | 123/90.44 |
| 4,967,705 | 11/1990 | Maciag et al. | 123/90.48 |
| 4,969,261 | 11/1990 | Igarashi | 74/569 |
| 5,054,440 | 10/1991 | Kadokawa | 123/90.5 |

*Primary Examiner*—E. Rollins Cross
*Assistant Examiner*—Weilun Lo
*Attorney, Agent, or Firm*—F. M. Sajovec

[57] ABSTRACT

A method for fixing an axle within a roller tappet in which a preload is applied to the axle in a direction perpendicular to its longitudinal axis while the ends of the axle are deformed into chambers formed in the ends of the axle-receiving aperture in the tappet body. In accordance with a preferred embodiment of the invention the axle ends are deformed by an orbital staking process.

5 Claims, 1 Drawing Sheet

PRELOADED AXLE STAKE FOR ROLLER FOLLOWER

The present invention relates to cam follower components for internal combustion engines, and more particularly to such cam followers incorporating a roller in contact with the cam.

It has become a common practice to support the roller on an axle which is retained within the follower member by means of a staking process which deforms the ends of the axle. Typically, in order to increase the axle retention fatigue strength of a roller follower, the amount of axle material which is mechanically displaced into the follower body is increased. Since the axle/body interface supports the valve gear load, the increased displacement improves the fatigue strength by increasing the bearing area at this interface. However, this increased displacement also transfers increased strain to the body which can result in fracture of the body, or it can result in distortion of the body which can affect the functional characteristics of the follower, particularly where the cam follower is a hydraulic tappet.

As illustrated in FIG. 3 herein, simply increasing the displacement causes the load bearing area of the follower body to be restricted to a relatively small area near the axle ends. Since the ends of the axle which are to be staked are left unhardened, when only the end areas of the axle actually bear the load, it is the relatively soft portion of the axle having a lower compressive yield strength which actually supports the load.

When the axle is loaded it is subjected to bending, which bending reduces the durability of the stake since it causes a cyclic sliding motion at the axle ends in the staking area. Eventually, the sliding motion tends to loosen the axle. Since the amount of deflection of the axle is a cubic function of the unsupported length, in the conventionally staked axle with only the end areas supporting the load, the deflection can become so severe as to cause premature loosening of the axle.

What the present invention provides is a method for staking a cam follower axle wherein a preload is applied to the axle while the ends of the axle are staked. As the axle is forced eccentric to the load bearing side of the axle hole from the preload and then held permanently in that position by the staking operation, the load bearing area is increased such that the entire length of the body axle hole is retained as a load bearing area, and the load is borne primarily by the hardened area of the axle. Also, in accordance with the present invention the unsupported length of the axle is reduced, thus reducing the deflection of the axle under load.

Other objectives and advantages of the present invention will be apparent from the following description when considered in connection with the accompanying drawing, wherein.

Figure 1:
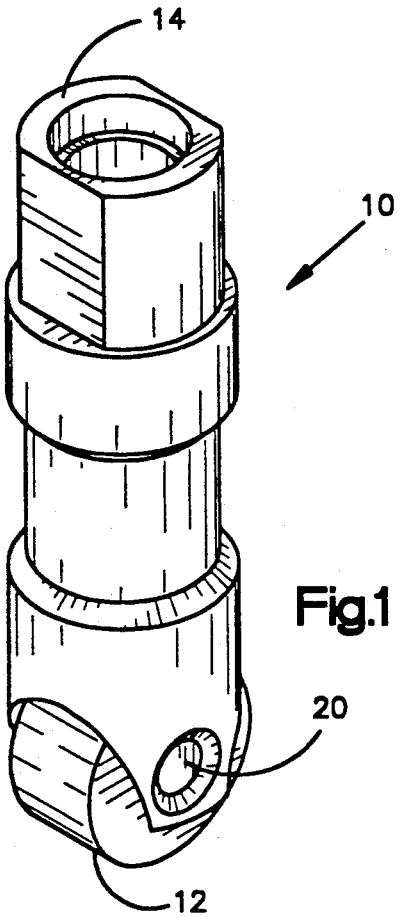
FIG. 1 is a perspective view of a hydraulic tappet incorporating a roller element.

Referring to FIG. 1, there is illustrated a cam follower in the form of a hydraulic tappet 10 for an internal combustion engine incorporating a roller 12 engageable with a valve actuating cam of the engine. As is well known by those skilled in the art, in a tappet of this type, the roller 12 engages the cam, and the head portion 14 engages a rocker arm which actuates the engine valve.

Figure 2:
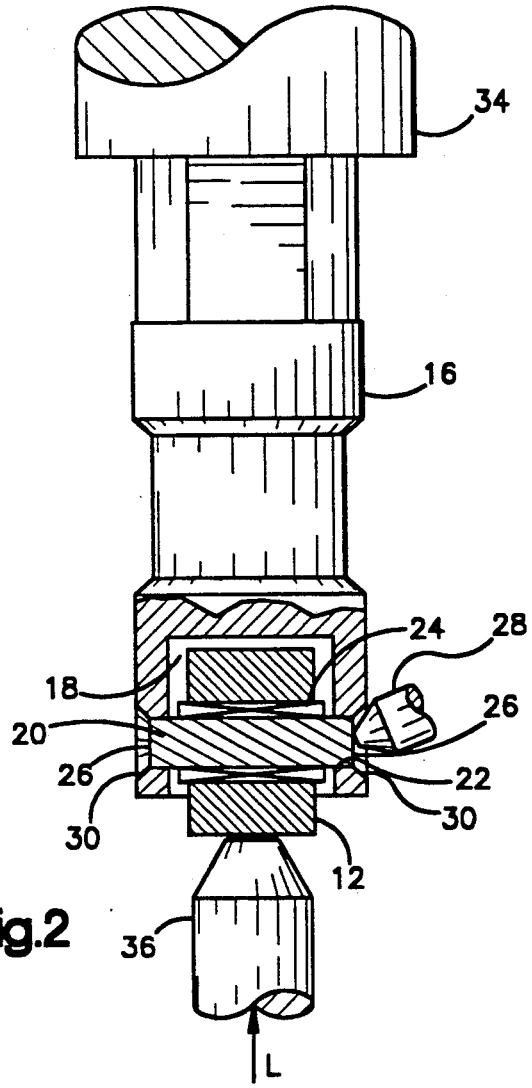
FIG. 2 is an elevation view, shown partly in section, of a roller tappet undergoing an axle staking operation in accordance with the invention.

Referring to FIG. 2, the body portion 16 of the tappet 10 has a recess 18 formed into lower end to receive the roller 12. The roller 12 is supported by an axle 20 received in a crossbore 22 formed through the body perpendicular to the longitudinal axis of the tappet, with a needle bearing 24 received between the axle and the roller.

In accordance with a known method for retaining the axle in the body the central portion of the axle is hardened and the end portions are left unhardened to permit the use of a staking process to retain the axle. As shown in FIG. 2, the ends 26 of the axle are axially compressed by means of a rod 28 which is maintained at an angle to the axis of the axle and orbited about the axis of the axle while applying sufficient force against the axle to deform the ends radially to expand the diameter of the end portion into compressive engagement with the bore 22 and to displace the material at the extreme ends of the axle into chambers 30 formed at the bore openings.

Figure 3:
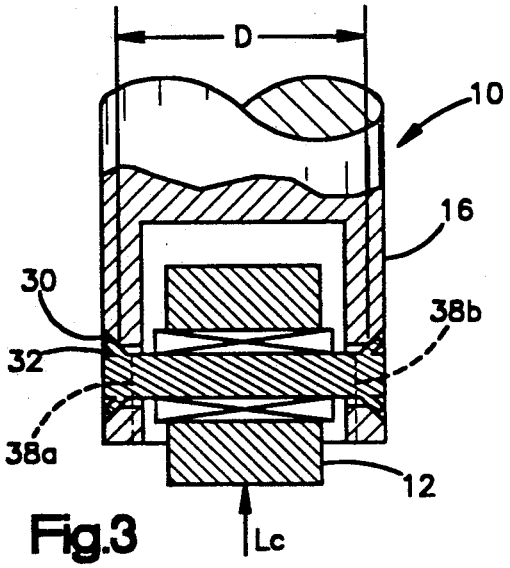
Fig.3 (PRIOR ART)
FIG. 3 is a fragmentary sectional view of a roller tappet incorporating a roller retained in accordance with a prior art method under load.
Figure 4:
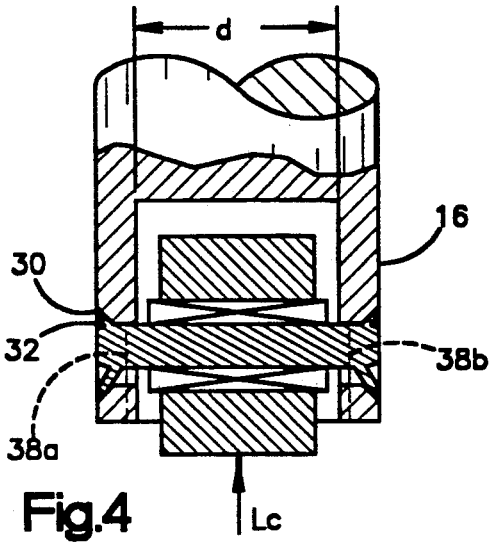
FIG. 4 is a view similar to FIG. 3, but showing a roller tappet under load incorporating a roller retained in accordance with the present invention.

The visible result of the above operation is illustrated in FIGS. 3 and 4 wherein an annular recess 32 is formed in the end of the axle and the end is expanded into the chamber 30.

In accordance with prior art practice, the above staking process has been carried out with the tappet body in an unloaded condition, which has led to the problems discussed in general terms in the introductory portion of this application, and which will be illustratively discussed in detail below. In accordance with the present invention the staking process is carried out with the body in a preloaded condition. Referring again to FIG. 2, the tappet body 16 is held in a suitable fixture (not shown) between a fixed base member 34 and a movable mandrel 36. While the staking operation is being carried out a compressive load L is applied to the roller 12 by the mandrel in the direction of the arrow. By way of example, a typical load applied to the body of a tappet intended for use in an automobile engine is from 2,000 pounds (907 kilograms) to 2,500 pounds (1,134 kilograms).

The above process does not produce any visible change in the tappet as compared with prior art processes; however, the practical results thereof are illustrated in FIGS. 3 and 4, which schematically illustrate the improvements provided by the inventive process, and which for purposes of such illustration exaggerate certain dimensional relationships among the tappet components.

FIG. 3 shows a roller tappet assembled using the prior art method wherein the axle is staked with the body in an unloaded condition. It can be seen that the staking process tends to uniformly displace the ends of the axle so that the axle is effectively centered within the bore 22. When a cam load $L_c$ is applied to the tappet, the load bearing area is essentially confined to a very small area wherein the unsupported load extends over a relatively large distance D. In contrast, FIG. 4 illustrates a roller tappet wherein the axle has been staked under a preload, which effectively maintains the axle in full contact with the body on either side of the recess during staking, which full contact is maintained under the operating load, thus maintaining the load bearing area over an increased distance, and wherein the unsupported load extends only over the much shorter distance d when compared with FIG. 3. This significantly increases the fatigue life of the axle assembly and minimizes the tendency for the axle to loosen under the cyclic load applied by the cam.

Another benefit of the invention can be appreciated by noting the broken lines 38*a* and 38*b* in FIGS. 3 and 4. These lines define the hardened area of the axle 20, the central area in engagement with the needle bearing being hardened and the outer area being left soft for purposes of the staking operation. Comparing FIGS. 3 and 4, it can be seen that in FIG. 3 under the operating load the contact area between the axle and the body is entirely within the soft area of the axle; whereas, in FIG. 4 a significant part of the contact area is within the hardened portion of the axle, thus increasing the strength of the stake.

I claim:

1. A method for fixing an axle within the body of a roller tappet comprising the steps of providing an aperture having chamfered ends through said body, inserting the axle into the aperture, and deforming the ends of said axle such that a peripheral portion of said ends extend into said chamfer, characterized by preloading said axle in a direction perpendicular to its longitudinal axis during said deforming step.

2. A method as claimed in claim 1, in which said preloading step includes positioning said body against a fixed surface and applying a predetermined load to said axle in the direction of said fixed surface.

3. A method as claimed in claim 2 in which said predetermined load is applied in substantially the same direction as the load to which said axle is subjected when said tappet is in operation.

4. A method as claimed in claim 2 in which said predetermined load is between 2,000 pounds (907 kilograms) and 2,500 pounds (1,134 kilograms).

5. A method as claimed in any one of claims 1 through 4 in which the ends of said axle are deformed by an orbital staking operation.

* * * * *